US007506769B2

(12) United States Patent
Howerton et al.

(10) Patent No.: US 7,506,769 B2
(45) Date of Patent: Mar. 24, 2009

(54) PUSHER-TYPE DISPLAY SYSTEM

(76) Inventors: Gary N. Howerton, 130 S. Front St., Apt. 508, Memphis, TN (US) 38018; Mikhail L. Marsky, 825 W. 187th St., Apt. 3G, New York, NY (US) 10033; Louis R. Csak, 15 Mortimer Dr., Old Greenwich, CT (US) 06870

( * ) Notice: Subject to any disclaimer, the term of this patent is extended or adjusted under 35 U.S.C. 154(b) by 0 days.

(21) Appl. No.: 11/835,043

(22) Filed: Aug. 7, 2007

(65) Prior Publication Data

US 2007/0267366 A1 Nov. 22, 2007

Related U.S. Application Data

(62) Division of application No. 10/486,614, filed on Dec. 7, 2004, now abandoned.

(51) Int. Cl.
*A47F 1/04* (2006.01)

(52) U.S. Cl. ..... 211/59.3

(58) Field of Classification Search ..... 211/51, 211/59.2, 59.3, 184; 312/61, 71
See application file for complete search history.

(56) References Cited

U.S. PATENT DOCUMENTS 5,161,702 A * 11/1992 Skalski ..... 211/59.3
5,322,171 A * 6/1994 Pingelton et al. ..... 211/59.3
5,605,237 A * 2/1997 Richardson et al. ..... 211/59.3
5,671,851 A * 9/1997 Johnson et al. ..... 211/51
6,523,703 B1 * 2/2003 Robertson ..... 211/59.3
6,820,754 B2 * 11/2004 Ondrasik ..... 211/59.3
7,293,663 B2 * 11/2007 Lavery, Jr. ..... 211/59.3
2003/0141265 A1 * 7/2003 Jo et al. ..... 211/59.3
2004/0065630 A1 * 4/2004 Ondrasik ..... 211/59.3

OTHER PUBLICATIONS

International Preliminary Examination Report—Nov. 20, 2003—PCT/US02/25587—this is the PCT of the parent application. See p. 3 with for reasoned statement. Claims in present application are the same as those examined in PCT.

* cited by examiner

*Primary Examiner*—Jennifer E. Novosad
(74) *Attorney, Agent, or Firm*—Wiggin and Dana LLP; Anthony P. Gangemi

(57) ABSTRACT

A display device has a spring-biased pusher carried on an elongate track. A sample carrier may be located at a front end of the track. A number of such tracks and pushers may be arrayed side-by-side with one or more pitch(es) corresponding to the products being displayed in a number of columns or lanes associated with each track and pusher. The sample carrier may include a principal portion unitarily formed with the track and one or more additional portions securable thereto to retain the sample.

8 Claims, 18 Drawing Sheets

PUSHER-TYPE DISPLAY SYSTEM

CROSS-REFERENCE TO RELATED APPLICATIONS

This application is the U.S. national phase of International Patent Application Ser. No. PCT/US02/25587, entitled "PUSHER-TYPE DISPLAY SYSTEM", that was filed on Aug. 12, 2002 and published in English on Feb. 20, 2003 as International Publication No. WO 03/013316, and claims priority of U.S. Provisional Patent Applications Ser. Nos. 60/311,499 and 60/366,497, filed Aug. 10, 2001 and Mar. 21, 2002, respectively and all entitled "PUSHER-TYPE DISPLAY SYSTEM," the disclosures of which are incorporated by reference in their entireties herein as if set forth at length.

BACKGROUND OF THE INVENTION (1) Field of the Invention

This invention relates to display systems, and more particularly to pusher-type shelf displays.

(2) Description of the Related Art

Myriad pusher-type shelf displays exist. For example, U.S. Pat. No. 4,830,201 (the disclosure of which is incorporated by reference in its entirety herein) shows an exemplary system. In many such systems, a plurality of pushers are respectively slidingly mounted on tracks for longitudinal reciprocation and spring urged into a forward position such as by a negator spring. When installed in a retail environment, each pusher can drive a longitudinal column of product toward a stop member at the front of the shelf. As the leading product in the column is removed, the pusher increments the remainder one step forward.

One particular field in which pusher-type displays may be utilized is the sale of hair coloring products. In such a use, each column of products may represent a different color of colorant. When used in that field, samples of colored hair may be located on the shelf, stop member, or other location near the front of the column to readily identify the contents of that column.

BRIEF SUMMARY OF THE INVENTION

In one aspect, a display device has an elongate track extending from back to front ends. A pusher is carried on the track for reciprocal sliding movement between rearward and forward positions. A spring biases the pusher forward. A sample carrier is positioned at the track front end. A number of such devices may be combined. Each such device may be positioned in a side-by-side array on an upper surface of a common shelf. There may be a number of product-carrying lanes, each lane associated with one of the pusher so that such pusher presses forward on a column of products in such lane so as to bias such column against a stop surface proximate the sample carrier. The combination may include an end member at the extreme first end of the array and cooperating with the adjacent device to define the extreme first end lane. The springs may be negator springs wherein an outer end of the spring is secured to a forward portion of the track and a coiling portion of the spring is carried by the pusher.

The sample carrier may include a base, unitarily formed with a major portion of the track. A cover may have first surfaces positioned to engage with mating surfaces of the base when installed thereon. A sample-holding insert may be installed to the cover via a sliding translation prior to installation of the cover to the base. The insert may be formed so as to not be nondestructively removable while the cover is installed to the base.

The cover may comprise a single piece of molded plastic. The insert may also comprise a single piece of molded plastic. The cover may be, at least for a partial area, transparent. The track member may have a number of predefined relieved areas permitting predetermined rear portions of the track to be broken off to shorten the track to accommodate a shelf having a particular depth onto which the track is placed.

Other aspects may involve features of the sample holder. For example, the holder may have a hair (e.g., human hair) or hair stimulant (e.g., plant or artificial fiber) sample secured thereto, may have means, such as rails, for slidably guiding insertion of the sample holder into a mating environmental cover member.

Another aspect involves a pusher-type display device in which an elongate track extends from back to front ends. The pusher is carried on the track for reciprocal sliding movement between rearward and forward positions. A first spring biases the pusher forward and a second spring biases the pusher rearward at least in a first condition. The second spring may be nondestructively disengaged by a user to place the display in a second condition wherein the second spring does not bias the pusher rearward. Advantageously, the first spring may exert a bias force of between 120% and 300% of a bias force exerted by the second spring at least along a majority of a distance between the rearward and forward positions.

Another aspect involves a pusher which has first and second conditions respectively presenting relatively narrow and wide contact spans for articles being displayed. The pusher may have a face plate portion rotatable between first and second orientations about a front-to-back axis to present the narrow and wide contact spans in the first and second conditions.

Another aspect involves the pusher display device mounting mechanism. The mechanism includes a mounting element with depending prongs for engaging mounting holes of a shelf. The mounting element is held relative to the track for transverse movement governed by a detent mechanism. The mounting element may comprise a single molded piece with the prongs depending from an underside of a body plate. The detent mechanism may include a number of transversely-arrayed detents on an upper surface of the body plate and a flexible catch on the track engaged thereto. The detent mechanism may advantageously have a detent pitch of 0.125 inch (3.2 mm) or less. Such pitch is advantageously less than a pitch of the mounting holes.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations indicate like elements.

DETAILED DESCRIPTION

Figure 1:
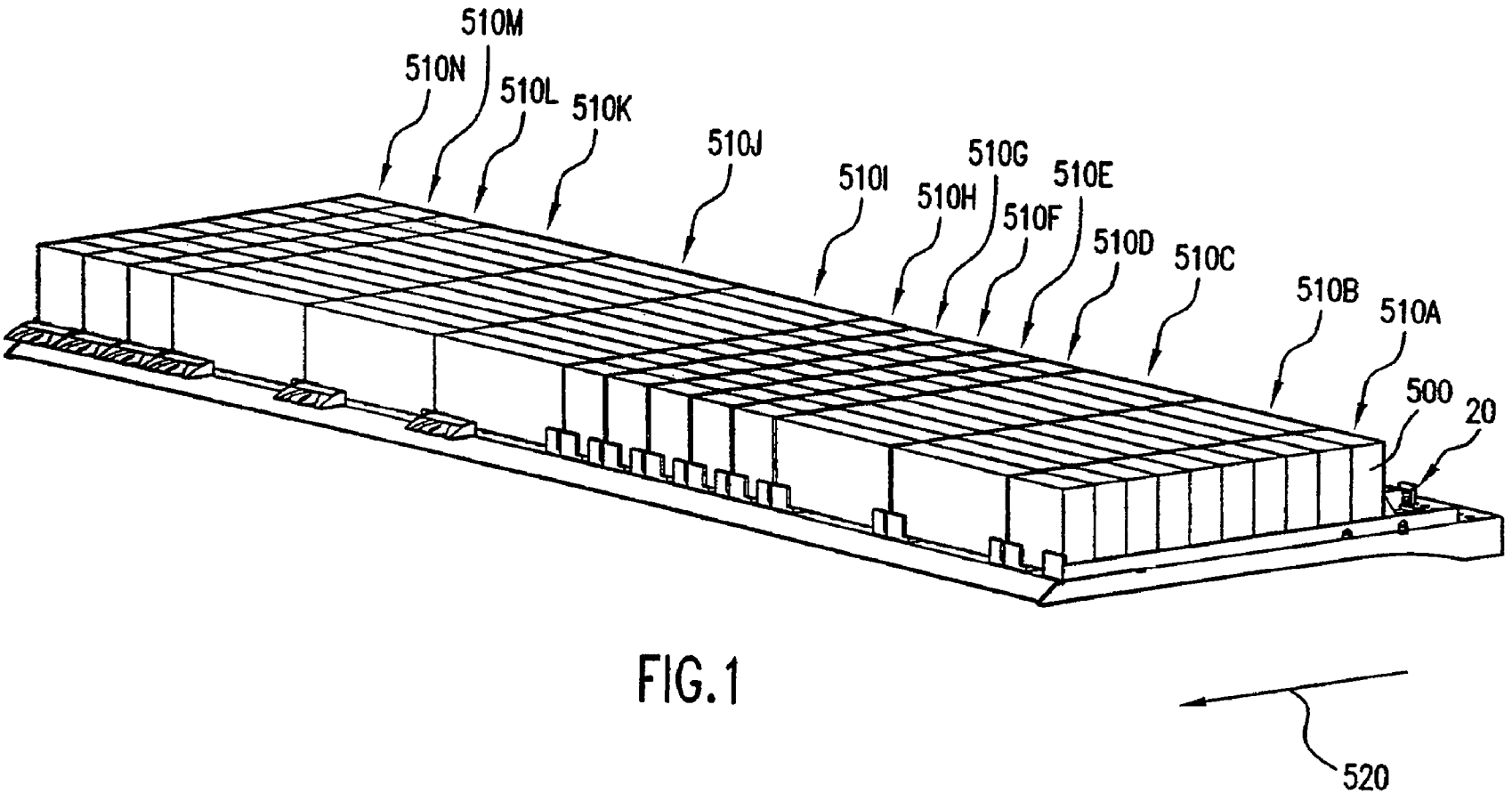
FIG. 1 is a view of an installed product-holding display system according to principals of the invention.
Figure 2:
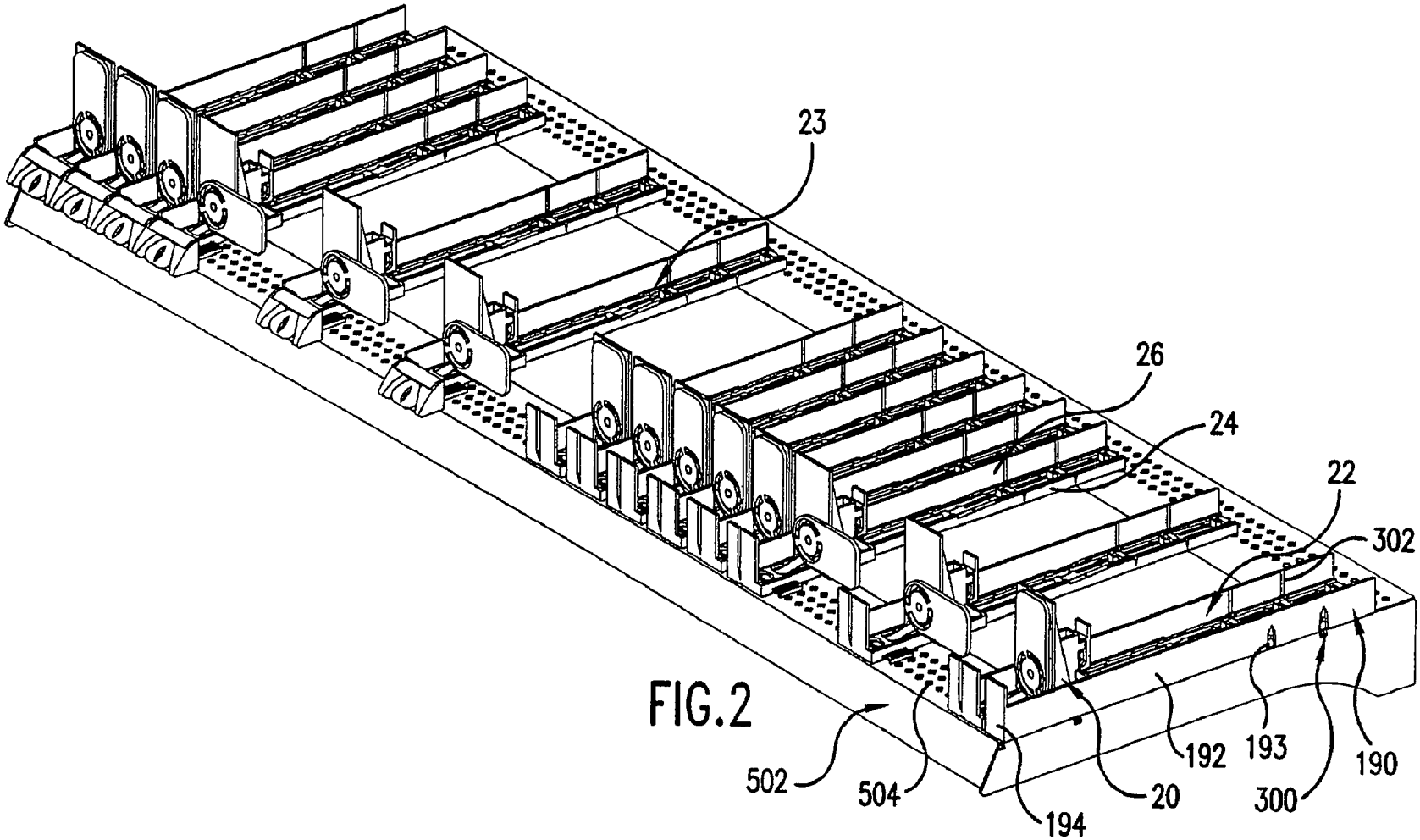
FIG. 2 is a view of the system of FIG. 1 without product.

FIG. 1 shows an installed display system for displaying and dispensing products 500 on a shelf 502, rack, or other support surface or structure. The products are arranged in back-to-front columns, each column being associated with a given lane 510A-510N. The columns are retained laterally in their associated lanes via inboard surfaces of a pair of associated walls (described below) and driven in a forward direction 520 by an associated pusher element 20. FIG. 1 shows the pusher elements 20 at or near a rearmost extreme of their range of travel. For purposes of illustration, FIG. 2 shows the system of FIG. 1 empty of product and with the pusher elements positioned as if held near the forwardmost extreme of their range of travel.

Figure 3:
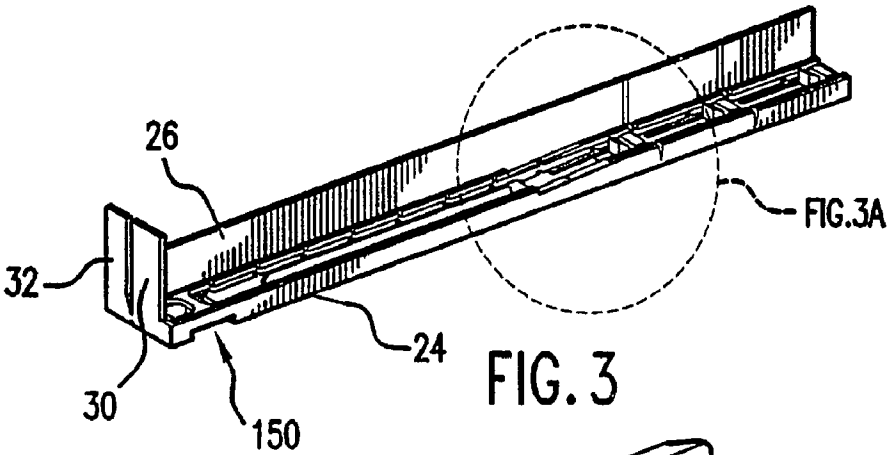
FIG. 3 is a view of a first base element of the system of FIG. 1.
Figure 3A:
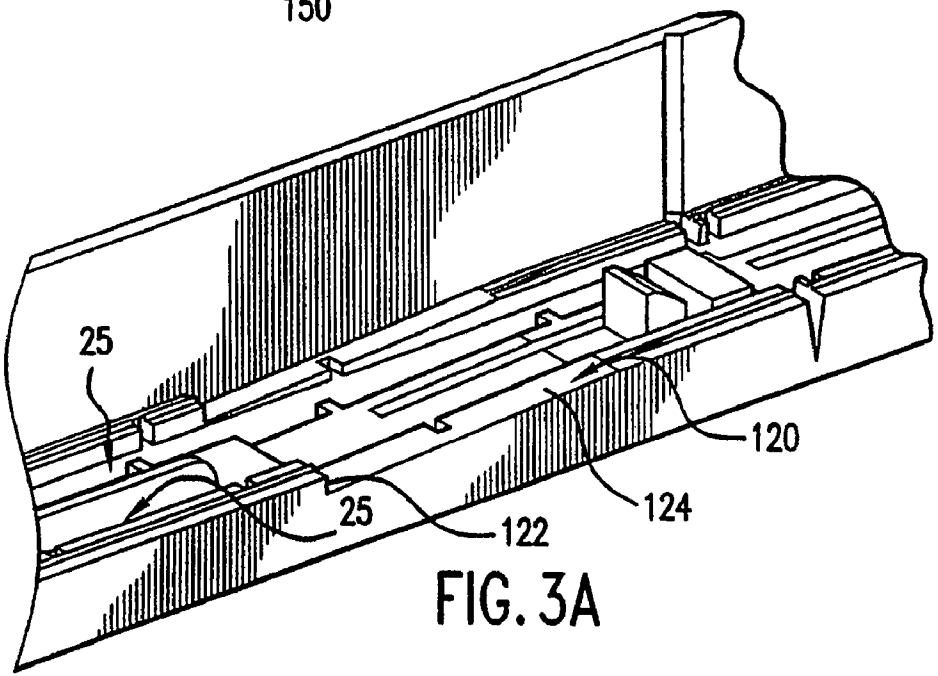
FIG. 3A is a view of a portion of the base element of FIG. 3.
Figure 4:
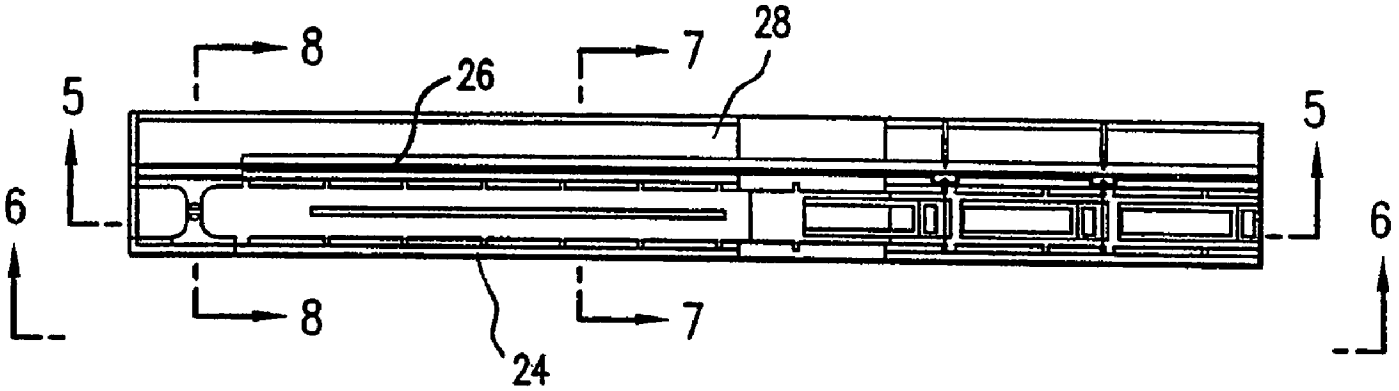
FIG. 4 is a top view of the base element of FIG. 1.
Figure 7:
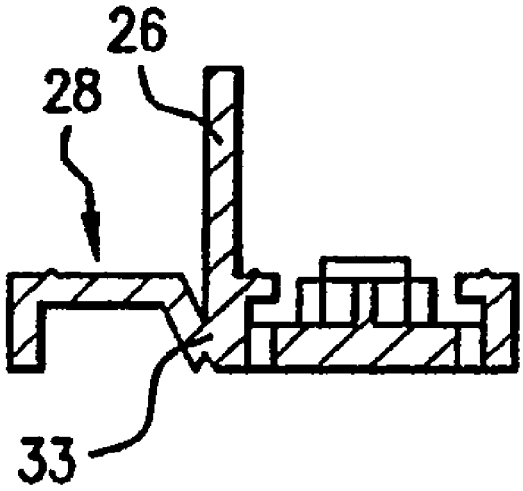
FIG. 7 is a transverse sectional view of the base element of FIG. 4 taken along line 7-7.

A principal component of the system is the combination of one pusher element 20 mounted on a base element or unit 22 or 23. Each base element is advantageously configured to be mountable directly atop the support surface/structure. Advantageously, a number of these combinations are mounted side by side on the shelf. An exemplary base element is unitarily molded (e.g., of polystyrene) comprises a longitudinally-extending track 24 to which the pusher 20 is mounted for longitudinal reciprocal movement between aft and fore locations. The exemplary track is oriented substantially horizontally and includes longitudinally-extending convolutions or channels 25 (FIG. 3A) receiving complementary features of the pusher (described below) to hold the pusher and restrict its movement to the longitudinal reciprocation. The base element further includes a longitudinal wall 26 upstanding from one side (e.g., the left side of the example from the point of view of a user facing the front rather than the back of the track and an outboard floor portion 28 (FIG. 4) on an opposite side of the wall 26 from the track. The base element further includes front wall portions 30 and 32 (FIG. 3) projecting upward from the track 24 and floor portion 28 on either side of the wall 26. In the illustrated embodiment, an inboard edge of the front wall portion of 30 is coincident with a forward edge of the wall 26 along the vertical height of the wall 26. As is described below, in the exemplary embodiment, the wall portion 32 is separated from the wall 26 by a gap permitting the wall portion 32 and floor portion 28 to be severed from the remainder of the base element along a predefined rupture zone 33 (FIG. 7).

A primary spring 34 (FIG. 9) biases each pusher 20 forward along the associated track 24. An exemplary spring is a coiled steel constant-force or negator spring having one end 36 secured proximate a forward end of the track and an accumulation 38 carried within the pusher. An exemplary force is eight ounces (2.2 N) with the pusher drawn by a user to a rearmost position, the accumulation is largely expended as a major portion of the length of the spring extends along one of track convolutions. Recoiling of the spring toward a natural state biases the pusher forward. When forward movement is permitted, such as by the removal of product from the front of a column of product associated with that pusher, the accumulation increases to drive the pusher forward. An oppositely oriented second spring 40 is also carried by the pusher, having an accumulation 44 and a free end 42 extending rearwardly therefrom and secured to the track toward a rear end thereof. The second spring 40 is advantageously somewhat weaker than the first spring, exerting a force typically between about 25% and 75% of the force of the first spring. When heavy product is to be carried by the unit, the free end 42 may be decoupled from the track, so as to eliminate the rearward force provided by the second spring and provide a greater net forward force on the column.

Figure 9:
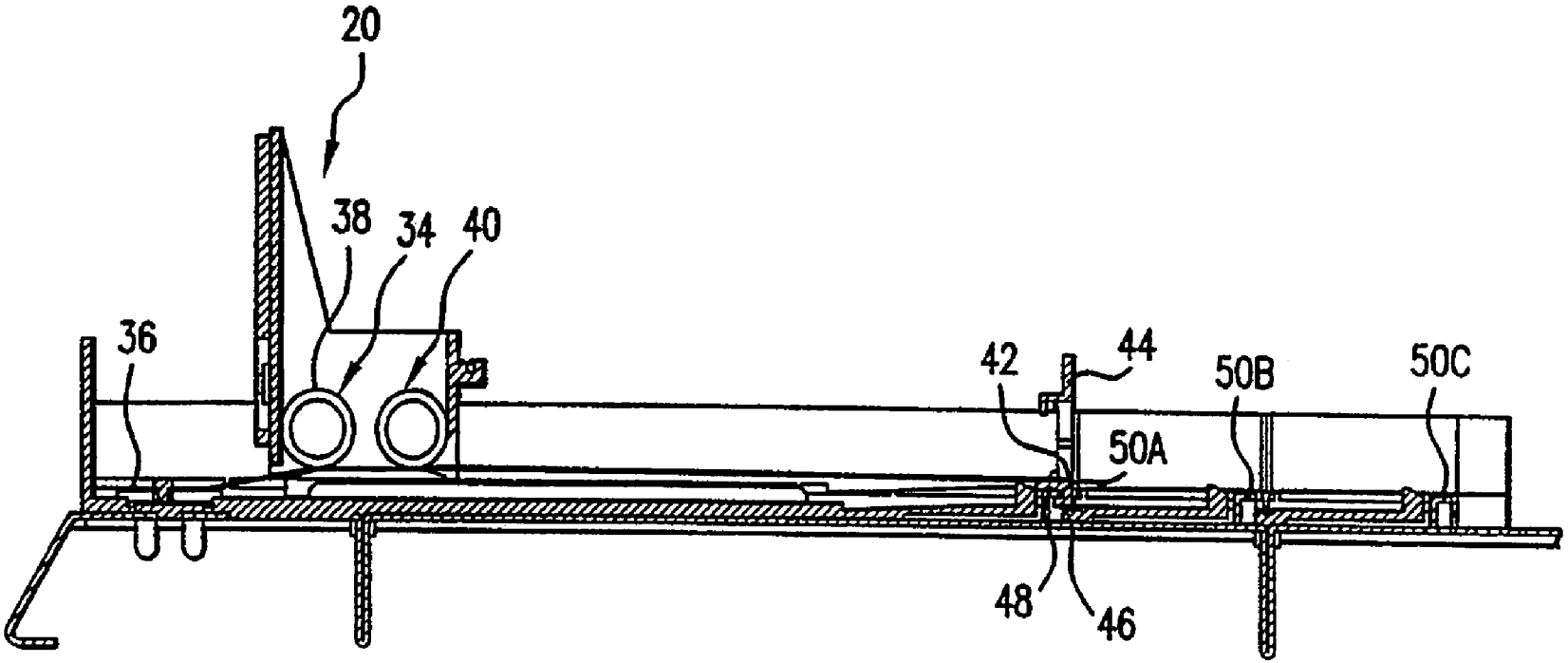
FIG. 9 is a longitudinal section view of a lane of the system of FIG. 2.
Figure 10:
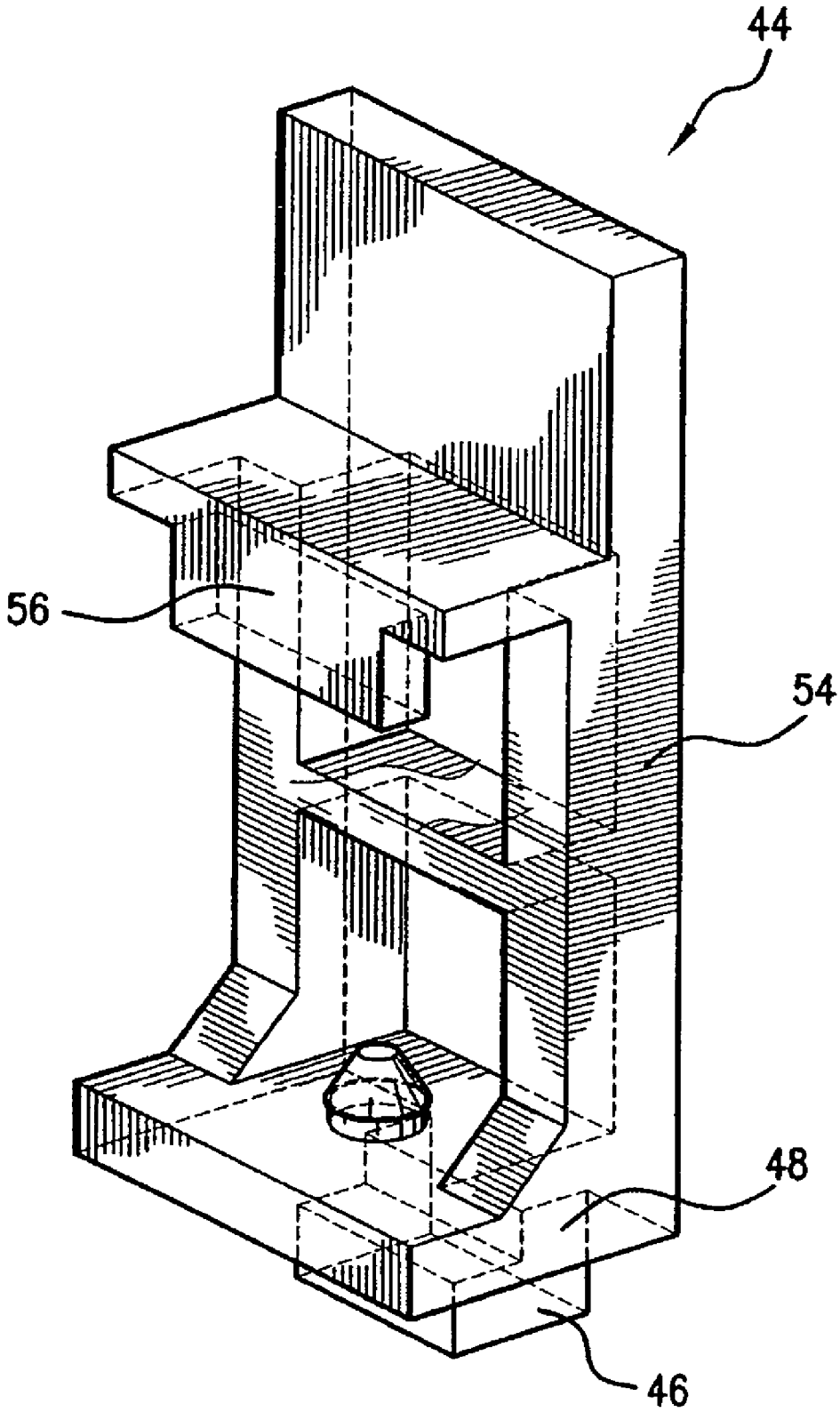
FIG. 10 is a view of a spring retaining clip of the lane of FIG. 9.
Figure 11:
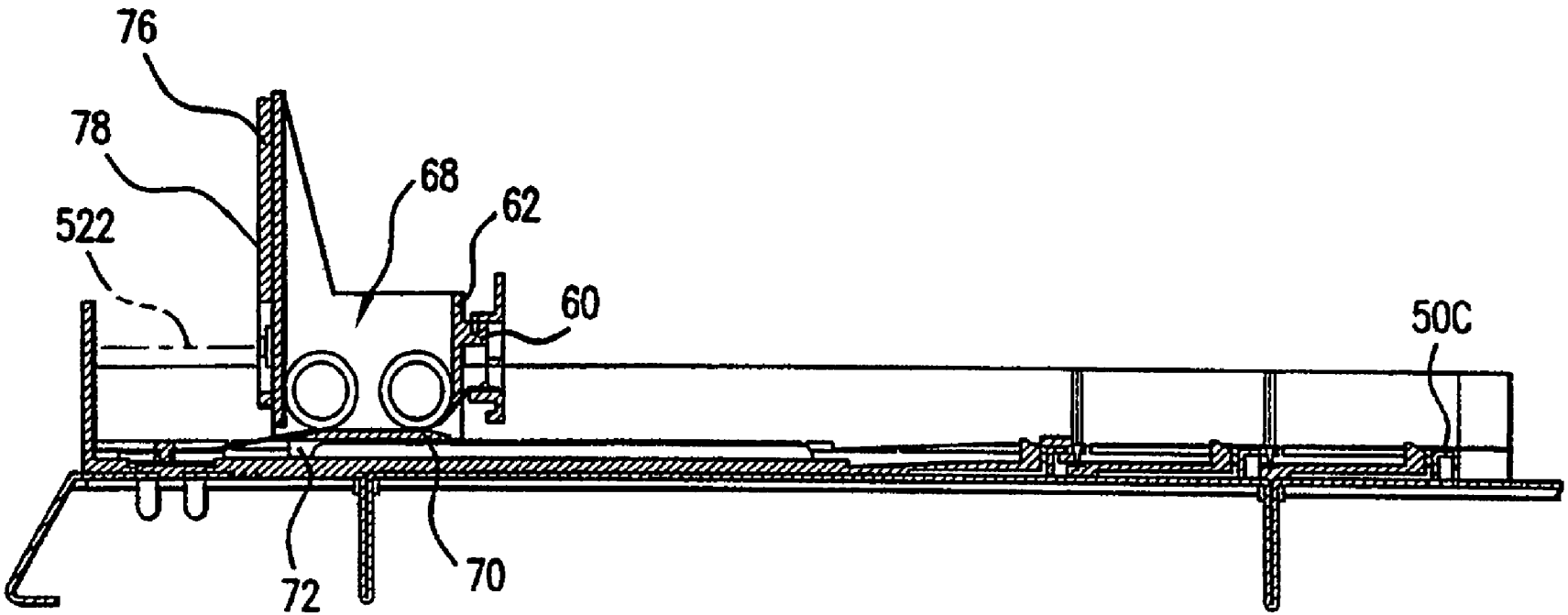
FIG. 11 is a longitudinal sectional view of an alternate lane.

In the exemplary embodiment, the free end 42 is mounted to a clip 44. An exemplary clip is advantageously molded of plastic (e.g., polypropylene). A foot 46 of the clip depending from a base 48 is provided for engaging a mating mounting feature of the track. FIG. 9 shows three such mounting features 50A, 50B, and 50C at three distinct longitudinal locations along the track. The provision of three such alternate features facilitates shortening of the track to a desired depth. The clip further includes an upstanding frame portion 54 extending up from a rear portion of the base. A finger 56 extends forward and downward from a front of an upper portion of the frame portion 54. In the exemplary embodiment, the finger 56 is provided for interaction with the pusher. Specifically, when the clip is disengaged from the track, the spring 40 may be allowed to relax, drawing the clip toward the pusher whereupon the clip may be hung by its finger from a mating hook feature 60 (FIG. 11) on a back wall 62 of the pusher.

The exemplary pusher 20 is advantageously formed having a molded plastic body piece 68 (e.g., of polypropylene) that includes a base portion 70 having depending legs 72 for engaging the track convolutions and carrying the spring accumulations. An upstanding frontal portion 74 serves for mounting a molded plastic (e.g., polystyrene) faceplate 76, the forward surface 78 of which engages the back surface of a rearmost product in the associated column. The faceplate and body have interengaged features permitting the faceplate to be rotated about a longitudinal axis 522 at least between a first orientation or other condition, (such as that of lane 510A of FIG. 1), in which the faceplate presents a relatively narrow contact surface and a second orientation (such as that of lane 510B of FIG. 1) wherein the faceplate presents a relatively wide contact surface. In the exemplary embodiment, this is achieved having the faceplate extending eccentrically of the axis 522.

Figure 13:
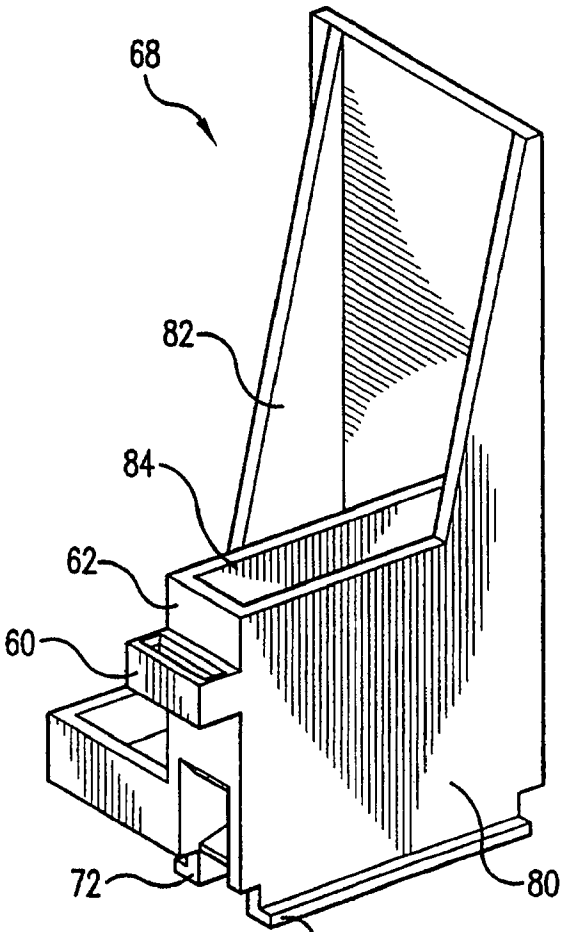
FIG. 13 is a view of the body of FIG. 12.
Figure 12:
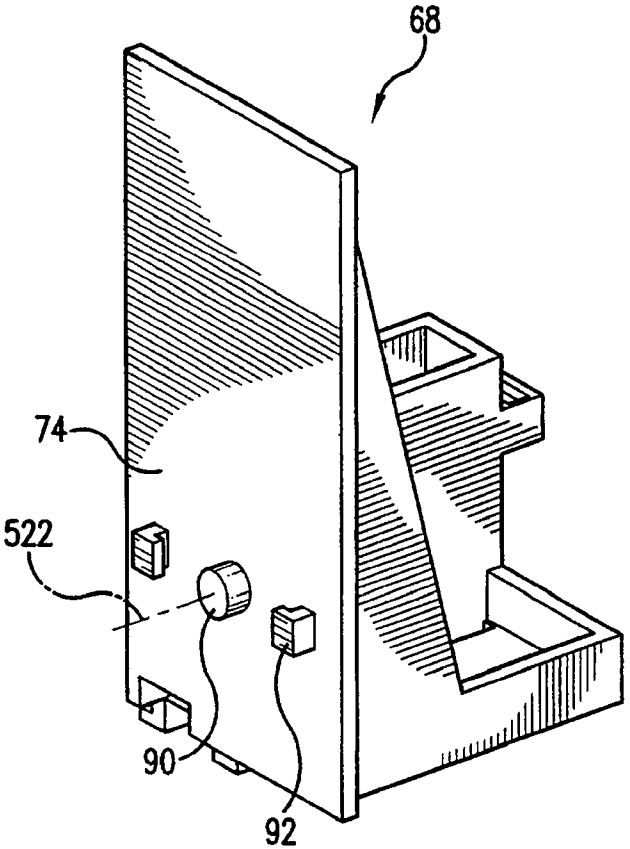
FIG. 12 is a view of a body of a pusher of the system of FIG. 1.
Figure 14:
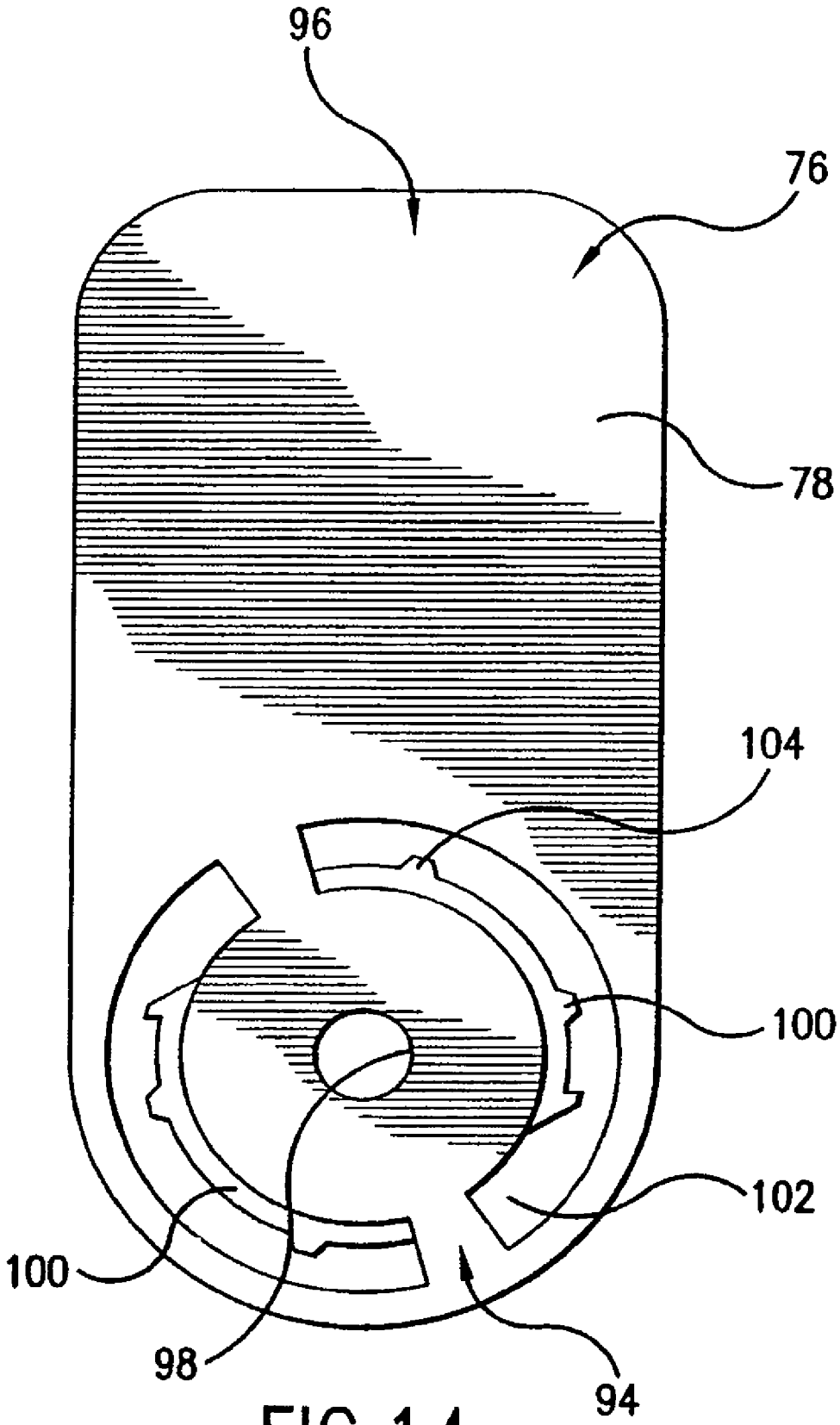
FIG. 14 is a front view of a faceplate of the system of FIG. 1.

FIGS. 12 and 13 show further details of the exemplary pusher body piece 68. The frontal portion is generally rectangular. A left wall 80 extends rearward from a left edge of the frontal portion 74. A right wall 82 extends rearward from the frontal portion slightly inboard of the right edge thereof. Both these exemplary walls reinforce the frontal portion. An intermediate wall 84 extends rearward from the frontal portion 74 spaced apart from the left wall 80 by a distance effective to create a compartment for accommodating the spring accumulations. Along rear edges, the walls 80 and 84 are joined by the pusher back wall 62. FIG. 12 further shows the faceplate interengagement features of the body piece 68 as including exemplary axle shaft 90 extending forward from the faceplate along the axis 522 and a pair of diametrically opposed fingers 92 projecting forward from the faceplate and inward toward the axle shaft. FIG. 14 shows further details of the faceplate 76 as having a semicircular first end 94 and a second end 96 formed as a rectangle with rounded corners. Relatively close to the first end, an aperture 98 is dimensioned to receive the axle 90 of the body piece. The exemplary faceplate is advantageously unitarily molded (e.g., of polystyrene) having a generally flat rear surface and the generally flat forward surface 78.

A flange 100 extends radially beyond a hub portion of the faceplate surrounding the aperture 98. The flange has interruptions 102 which permit passage of the body piece fingers 92 when the faceplate is installed to the body piece 68. After such installation, the faceplate is rotated about the axis 522 to bring the flange 100 within the grasp of the fingers 92. A series of radial projections 104 along the flange provide detents for engaging sides of the associated fingers 92 to selectively hold the faceplate in either its narrow (vertically-extending) or wide (horizontally-extending) orientations.

Figure 15:
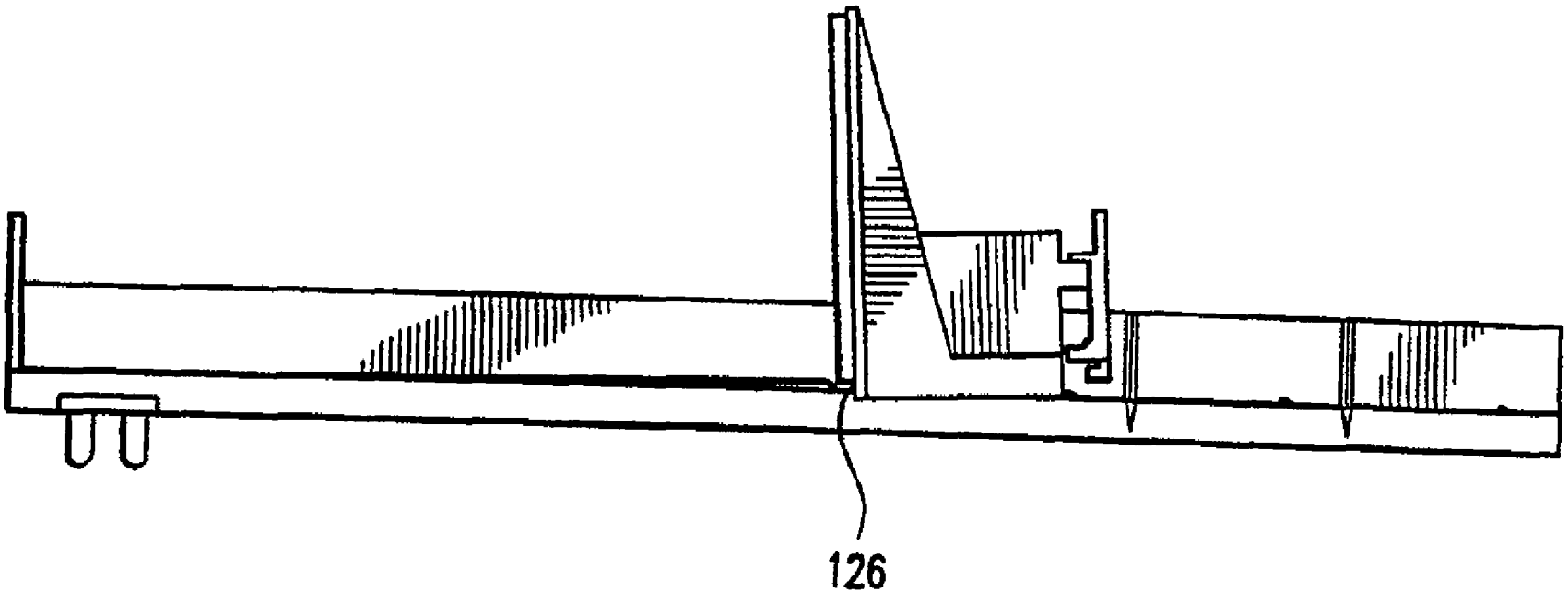
FIG. 15 is a side view of a locked pusher.

For loading of product, the pusher may be pushed back to an appropriate location above a depressed area 120 (FIG. 3A) of the track 24 having a generally vertical frontal surface 122 and a rearwardly inclining surface 124. When above this depressed area, the pusher may be rotated downward so that a lower front edge portion 126 (FIG. 15) abuts the surface 122 so as to retain the pusher against the force of the primary spring. The product may then be loaded, whereupon the pusher may be rotated back to disengage the pusher body from the surface 122.

Figure 16:
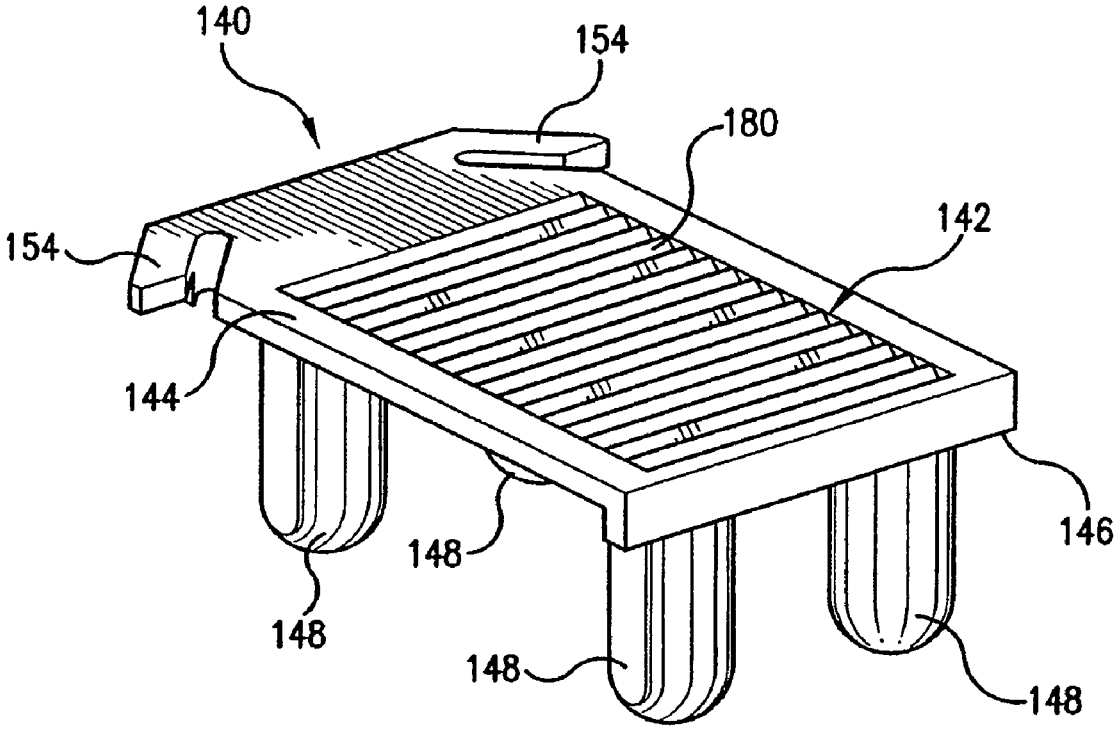
FIG. 16 is a view of an adapter.
Figure 17:
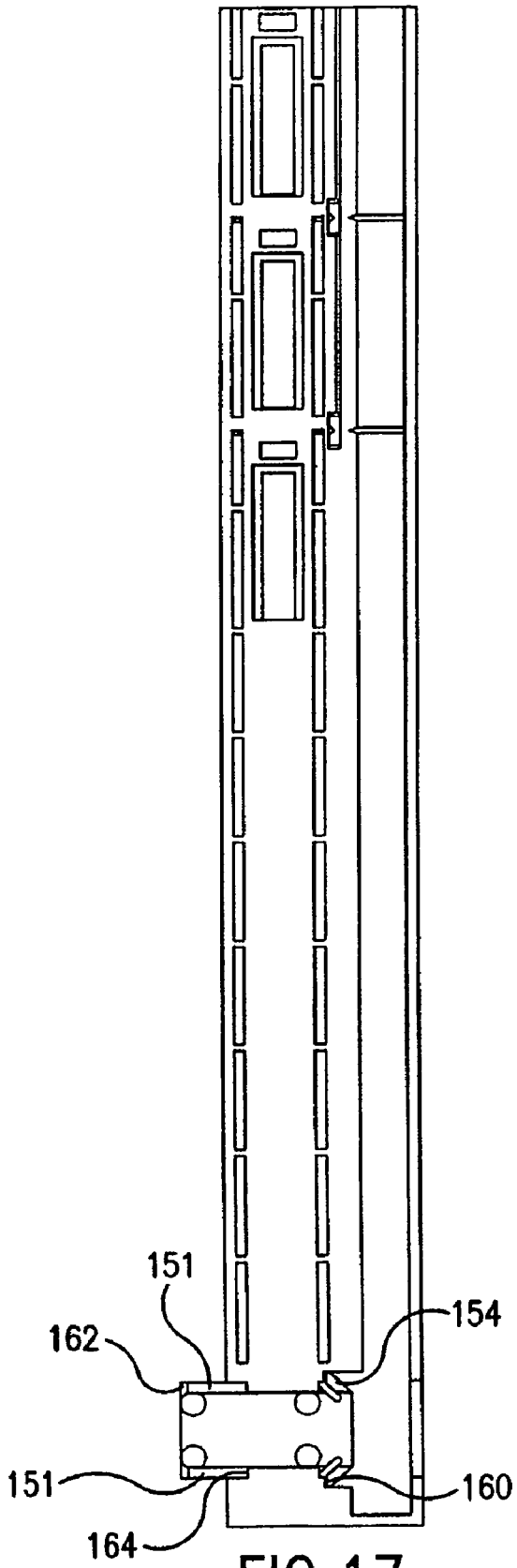
FIGS. 17 and 18 are bottom views of a track with the adapter of FIG. 16 in respective rightmost and leftmost positions.
Figure 18:
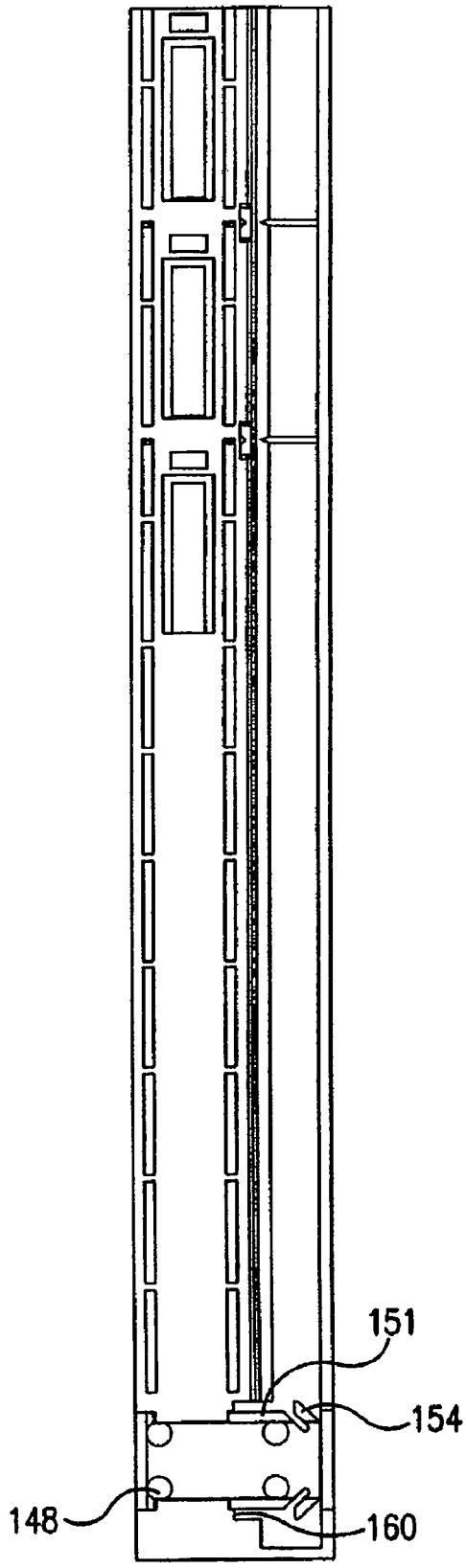

The shelf 502 advantageously includes one or more arrays of mounting apertures 504 (FIG. 2). Such arrays are usually adjacent at least the front edge, are often adjacent a rear edge, and are occasionally at intermediate locations along the shelf. The arrays are often of a standard pitch, such as 1 inch (2.5 cm) on-center or ½ (1.27 cm) inch on-center or similar metric dimensions. Depending on the transverse dimensions of the articles being dispensed, it may be advantageous to more finely transversely position the base units so that the space between adjacent wall surfaces more closely corresponds to such width. To provide such fine adjustment, the exemplary system includes an adapter 140 (FIG. 16) for mounting each track member to the shelf. The adapter is advantageously molded plastic (e.g., polystyrene) and includes a plate-like body 142 having an upper surface 144 and a lower surface 146, from which a plurality of legs 148 depend. The legs are positioned to mate with the mounting apertures of the shelf. The body 142 is captured within a transversely-extending slot 150 (FIG. 5) in the underside of the track near the front thereof. The exemplary slot 150 is open to both the sides of the track. On forward and rear extremities of the body, the lower surface 146 is recessed upward, allowing the extremities 151 to be captured above complementary rails 152 at the sides of the bottom mouth of the slot to maintain vertical engagement between adapter and track. The adapter includes a pair of self-sprung barbs 154 that permit the adapter to be inserted in the slot (e.g., from the right side of the track) but, once inserted, engage blocking surfaces 160 (FIG. 17) to prevent the adapter from being fully withdrawn from the slot. A right end wall portion 162 extending below the recessed extremities of the lower surface may similarly engage a blocking surface 164 to define a maximum insertion of the adapter. The adapter has a transverse range of movement within the slot that is advantageously at least equal to half the shelf mounting aperture pitch, but, in the exemplary embodiment, is substantially equal to that pitch. Movement within this range is subject to influence of a detent mechanism provided by a transverse array of detent grooves 180 in the adapter upper surface 144 (FIG. 16) and a mating flexible catch portion 182 (FIG. 5) of the track depending into the slot. The detent grooves 180 are at a relatively fine pitch (e.g., one-sixteenth or 0.063 inch (1.6 mm)) allowing a correspondingly fine lateral positioning. A broader advantageous pitch range is from 1 mm to 2.3 mm.

The pitch of the tracks and thus the width of the associated lanes accommodating the column of products will largely be determined by the size (width) of the products. At one extreme end of the array of units (e.g., the right extreme in the illustrated embodiment), the associated lane may be bounded at its outboard side by an additional wall element 190 (FIG. 2) separate from any track on which a pusher rides. The exemplary additional wall element advantageously consists essentially of portions 192, 193 and 194 similar to the wall 26, floor portion 28, and front wall portion 32 of the main base units and may be secured by a similar adapter or by integral mounting legs.

The front walls 30 and 32 advantageously may serve as a stop preventing forward movement of products in the column of products supported along the track. Leftward movement of the products is restrained by the right face of the associated wall 26. Rightward movement of the products may be restrained by the left face of the wall 26 of a similar base unit to the right of the subject base unit or of the wall 162. On the leftmost base unit in the array of base units on the shelf, the wall 32 and floor 28 may be removed by breaking along the rupture zone 33 (FIG. 7) to create an orderly appearance.

Figure 19:
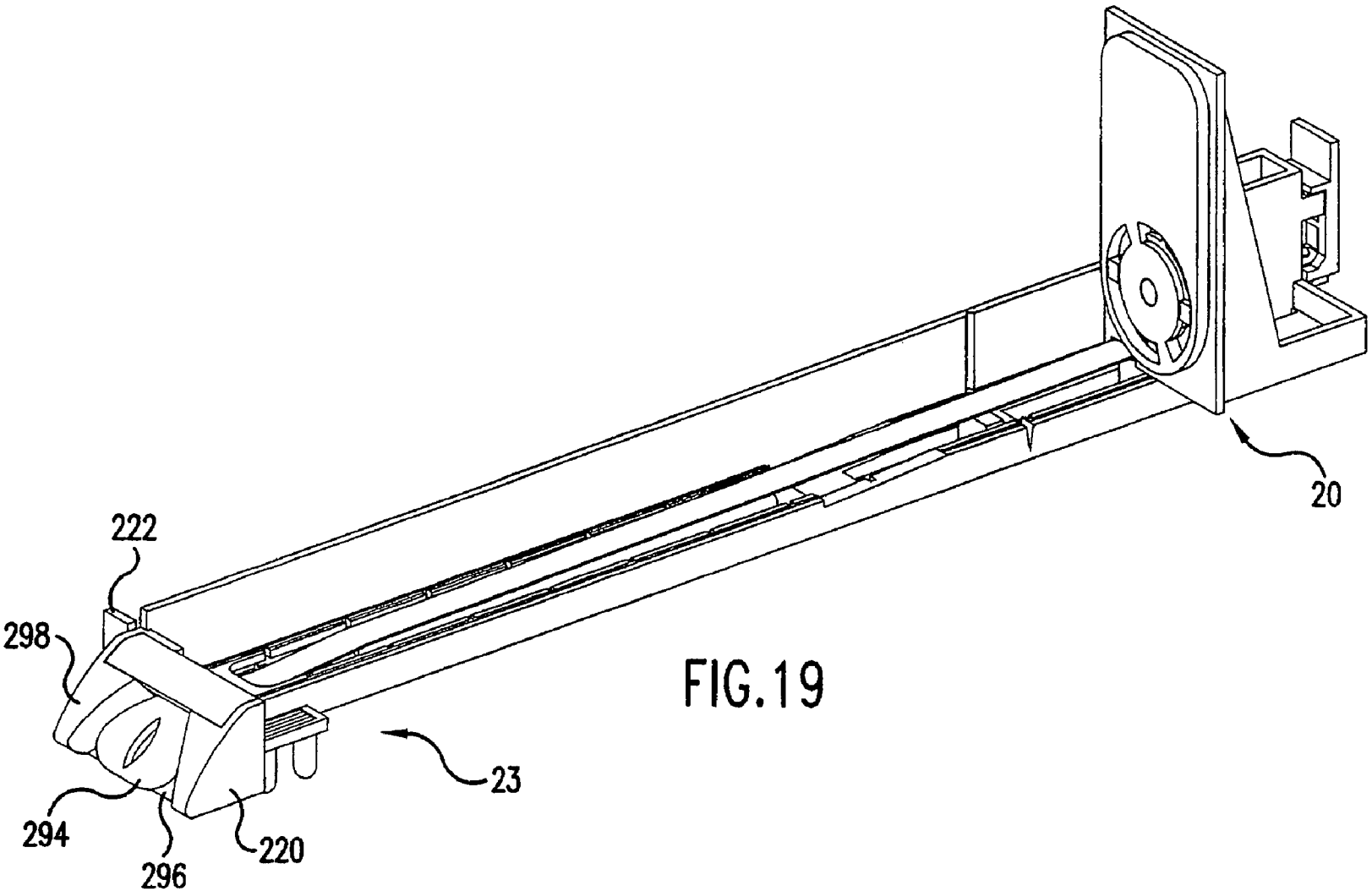
FIG. 19 is a view of a base element including a sample holder.
Figure 20:
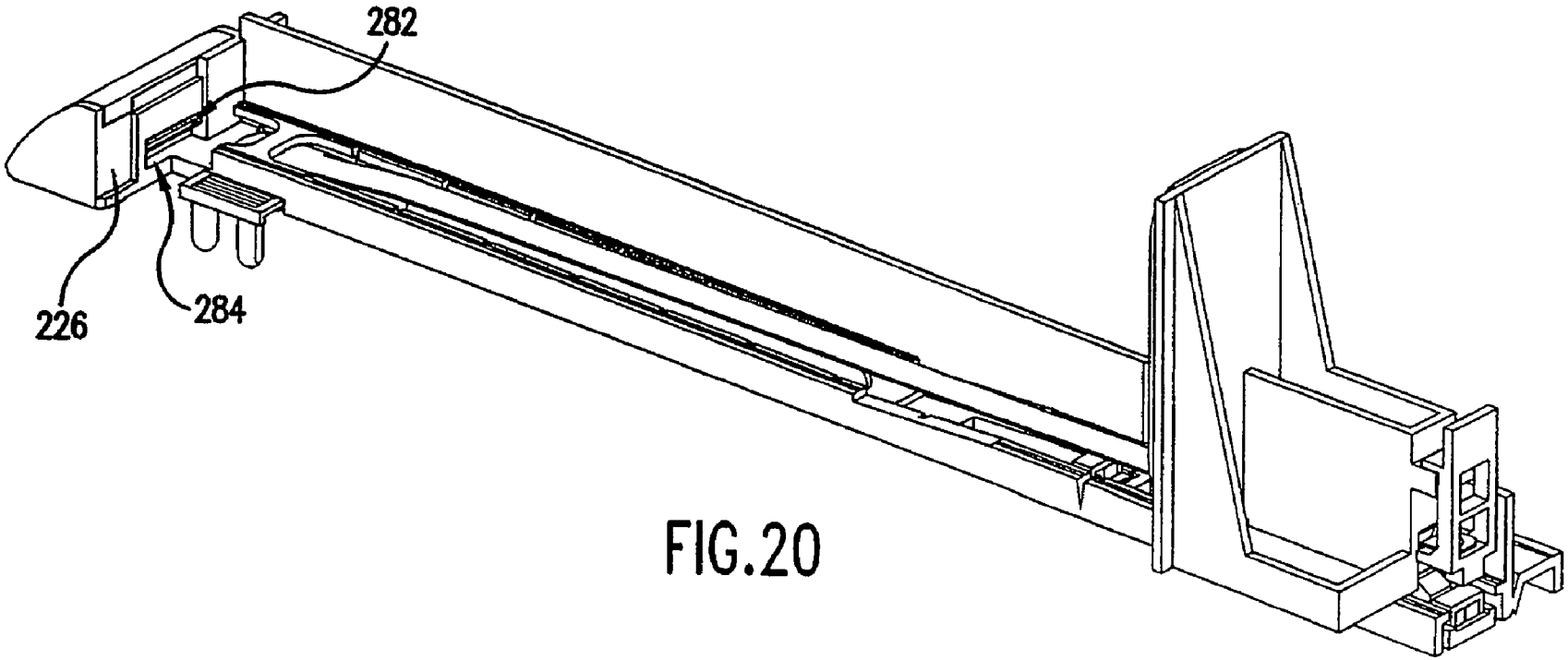
FIG. 20 is a view of the base element of FIG. 19.
Figure 21:
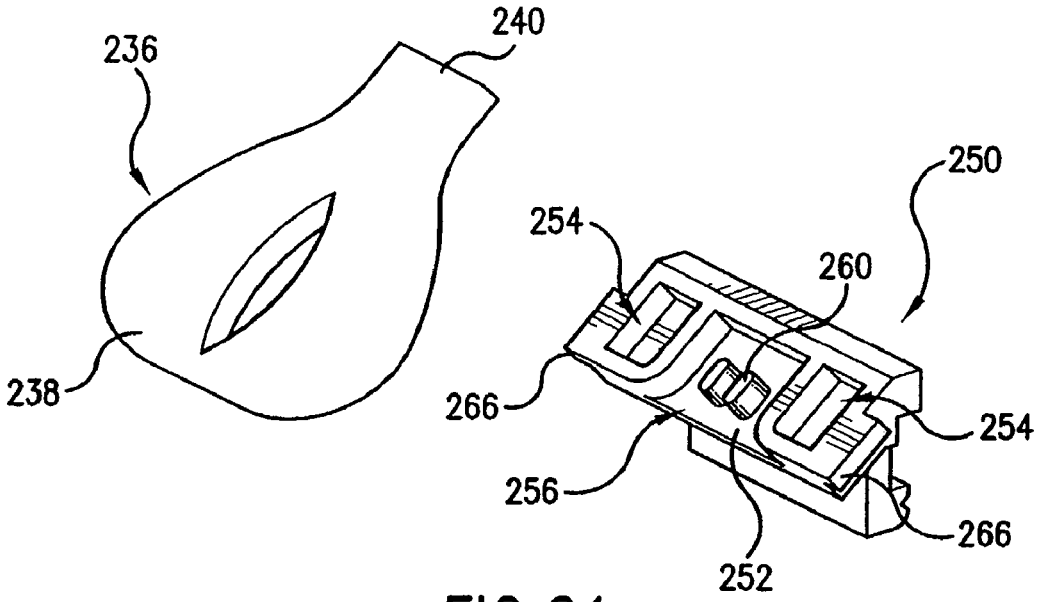
FIG. 21 is an exploded view of a sample and insert assembly.

The front of the base unit may include the body or base of a sample-holding fixture (sample carrier). FIG. 19 shows a base unit 23 to which a pusher 20 is mounted. The track and side wall of the base unit are unitarily molded with the body 220 of a sample holder. Extending from the opposite side, the base unit 23 may include a frontal wall portion 222 analogous to the frontal wall portion 32 of base unit 22, with the body 220 extending generally in place of the frontal wall portion 30. The right side portion of a rear end of the body 220 is provided with a recessed area 226 dimensioned to accommodate the frontal wall portion 222 (or 32) in a minimum pitch configuration. The exemplary body 220 has a width approximately equivalent to the width of the pusher in its narrow orientation.

An exemplary sample 236 comprises a swatch 238 of hair in which ends 240 of the swatch (and associated hairs) have been glued or otherwise secured with adhesive to form a loop. Hair samples are typically associated with display of hair colorant or other hair care products. In displaying hair color products, each lane of product may have therewith associated a different color of hair sample. The presence of a variety of hair sample colors poses particular pilferage problems in that such samples are particularly useful in the manufacture of fishing lures. Thus, it is advantageous to provide a relatively secure yet convenient structure for holding hair samples. When used in the retail environment, it may be advantageous that hair colorants or other hair care products of more than one manufacturer utilize an identical or similar display system so as to provide a consistent appearance on the shelves of a given retailer.

An insert element or nest 250 is molded (e.g., of polystyrene) with an exemplary U-shaped cross-section having a floor portion 252 and two side portions 254, the interior 256 of which may accommodate the proximal portion of the swatch. The proximal portion may be secured to the insert such as via hot melt glue, epoxy, or other adhesive. The insert may include features for engaging the sample such as a pair of legs 260 upstanding from the floor portion and around which the sample may be looped. A distal portion of the sample may extend out beyond the insert. The sample may be secured to the insert offsite of the retail environment, for example, by the manufacturer of the hair colorant or a third party contractor, and may be mated to the remainder of the system during its installation or subsequently for update or similar purposes.

Figure 22:
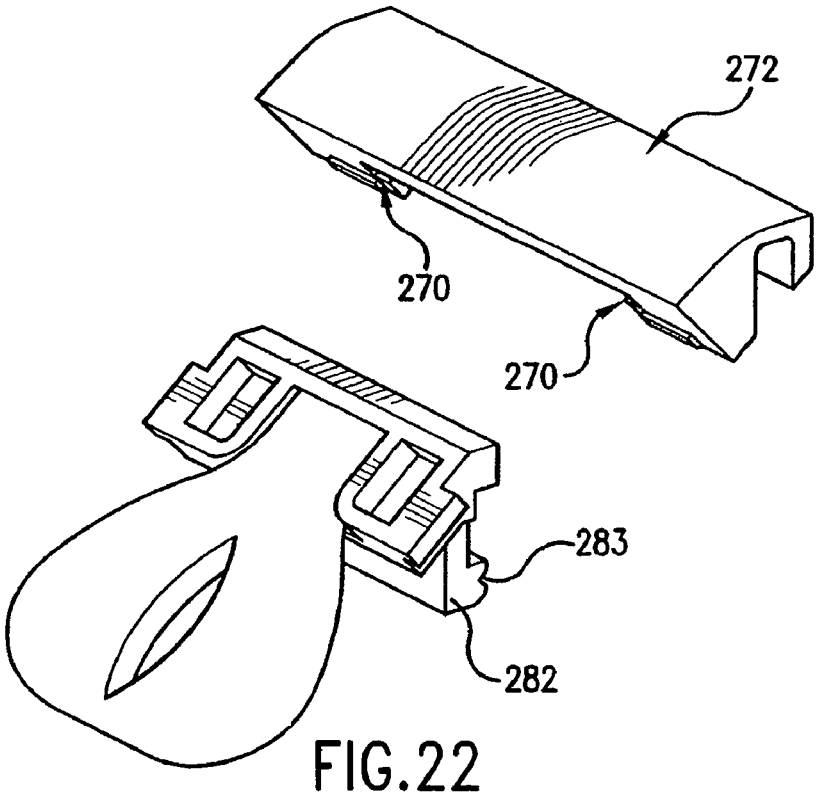
FIG. 22 is a partially exploded view of an assembly of the assembly of FIG. 21 and a cover.
Figure 23:
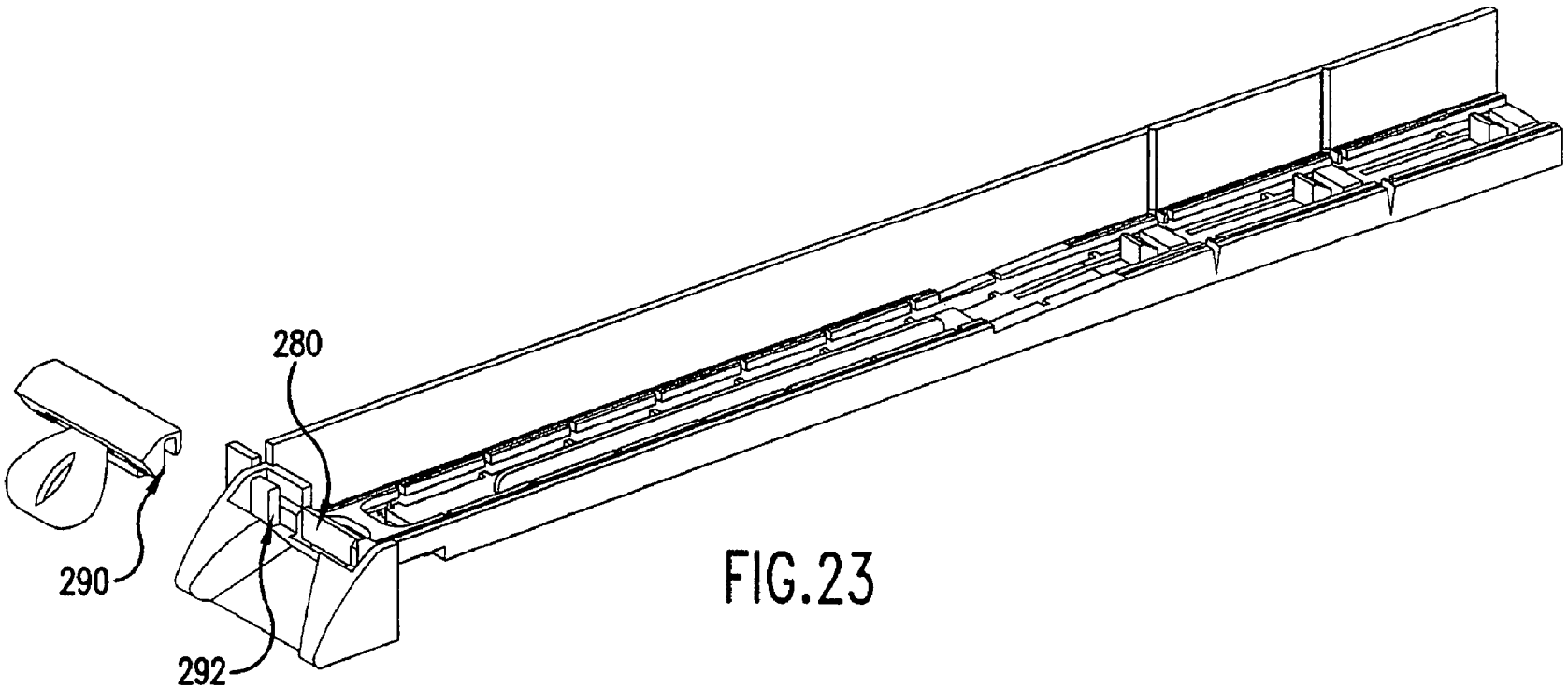
FIG. 23 is an exploded view of the assembly of FIG. 22 and base element.

The exemplary insert is molded with a pair of rails 266 protruding from outboard sides of the respective side portions 254. The rails may be accommodated by complementary channels 270 in a cover member 272 (FIG. 22) into which the insert is inserted. With the insert mated to the cover, the assembly may be secured to the sample-holding fixture base portion. As the assembly is pressed downward into a mating compartment 280 (FIG. 23) of the sample-holding fixture base portion, a barb or projection 282 (FIG. 22) projecting rearward from a back plate portion 283 of the insert becomes captured by an aperture 284 in the back of the fixture base portion. A downwardly open channel 290 also receives an upwardly directed wall 292 of the base portion.

In the exemplary embodiment, the distal portion 294 (FIG. 19) of the sample is draped over a curved support surface 296 at the front of the fixture bounded by divergent lateral walls 298 to help locate and protect the sample while still providing customers with a direct view of the sample and even the ability to touch the sample. However, casual pilfering of the sample is difficult due to the need to disengage the insert from the fixture. This, however, can be done by inserting a finger or tool behind the fixture to flex the barbed projection 282 out of engagement with mating aperture surface of the fixture to permit upward removal of the assembled insert and cover. This possibility, however, is not readily apparent to the casual pilferer. In the exemplary embodiment, the cover member 272 covers only a proximal portion of the sample as may be appropriate for security. In alternative embodiments, the cover member may cover more or even all the sample. In such cases, it may be desirable that the cover be all or at least partially transparent. Other sample holders are possible, such as for alternate samples. For example, in manufacture, a special mold tool for the base of the alternate holder may be used with an existing mold for the remainder of the base element.

In the exemplary embodiment, the sample carrier is immediately in front of the pusher at the front end of the subject track and extends to one side (i.e., the right of the sidewall in the exemplary embodiment).

In the exemplary embodiments, the pushers extend laterally beyond the outboard extreme of their associated tracks. This permits a minimal pitch configuration where desired for small (narrow) products in which the floor portion of each base unit or the additional element is brought closely adjacent to the track of the next unit and an outboard portion of the pusher of the such next unit extends above such floor portion. The sample-holding fixtures may be shaped so that, in this pitch, the short frontal wall of the next base unit or additional element is located behind an outboard portion of the fixture. The sample-holding fixture may alternatively be particularly narrow so as to cover only a portion of the associated lane. This may be similar to the span of the illustrated frontal walls 30 wherein the minimal pitch configuration the frontal wall 30 of one base element is closely adjacent to the frontal wall element 32 of the next element to the right or to a similar frontal wall of the additional element.

Figure 5:
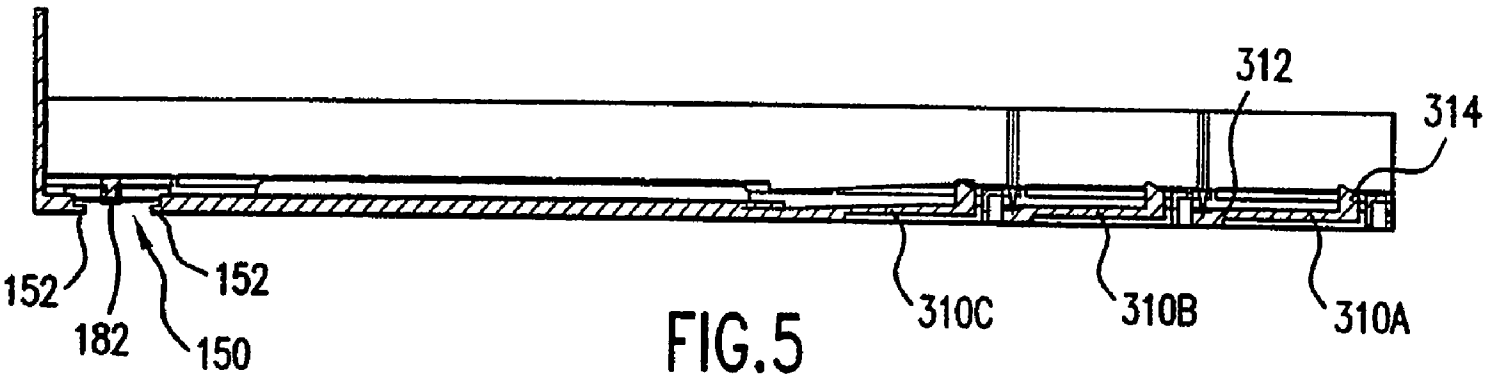
FIG. 5 is a longitudinal sectional view of the base element of FIG. 4 taken along line 5-5.
Figure 6:
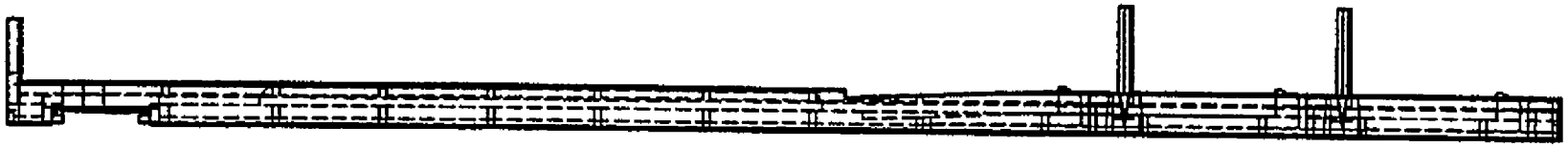
FIG. 6 is a right side view of the base element of FIG. 4.
Figure 8:
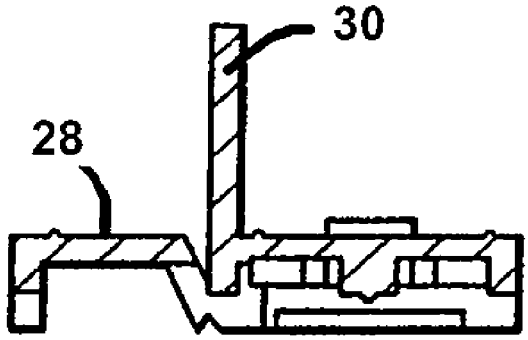
FIG. 8 is a transverse sectional view of the base element of FIG. 4 taken along line 8-8.

To provide for longitudinal adjustment to accommodate the desired depth of shelf, the base units and the additional element are advantageously provided with apertures 300 (FIG. 2) or other relieved areas 302 which define predetermined preferential rupture locations for breaking off predetermined rear lengths to shorten the units accordingly. In the exemplary embodiment, there are two such sets of features associated with two different longitudinal locations, permitting: a long initial length; an intermediate length provided by breaking at the rear of the two sets; and a shortest length provided by breaking at the front of the two sets. From rear-to-front the exemplary track is also provided with three stop portions 310A, 310B, and 310C (FIG. 5). Each stop portion extends rearward from a root 312 to a tip protuberance 314. Tip protuberances have a relatively vertical front surface and a rearwardly tapering rear surface. The rear surface taper permits a pusher to be slid forward over the protuberance, downwardly camming the protuberance and downwardly flexing the elongate body of the stop until the pusher has passed over the protuberance and the stop snaps back into place. If the pusher is pushed rearward until its body contacts the forward surface of the protuberance, an absence of camming interaction may prevent further rearward movement of the pusher unless the protuberance is manually depressed such as by a user's finger. In the exemplary embodiment, the three stops are associated with the three possible lengths. If the base element is to be left in its longest length, the forward two stops may be broken off at their roots. If shortened to the intermediate length, the shortening will remove the rearward stop and the user may then break off the forward stop. A corresponding process could be provided if there are more sets of rupture locations and stops.

One or more embodiments of the present invention have been described. Nevertheless, it will be understood that various modifications may be made without departing from the spirit and scope of the invention. For example, for wider products alternate versions may be made wherein each base unit includes two pushers on either side of a wall so that each column may be supported on both sides by a pusher. Accordingly, other embodiments are within the scope of the following claims.

What is claimed is:

1. A display device comprising:

an elongate track extending from a back end to a front end;

a pusher carried on the track for reciprocal sliding movement between rearward and forward positions;

a first spring biasing the pusher forward toward the front end of the elongate track; and a second spring configured to be nondestructively disengageable with the back end of the elongate track in first and second conditions, wherein when the second spring is engaged with the back end of the elongate track in the first condition, the second spring biases the pusher rearward toward the back end of the elongate track simultaneous to the first spring biasing the pusher forward toward the front end of the elongate track so that the pusher is being biased forward by a first net forward force and when the second spring is disengaged from the back end of the elongate track in the second condition, the second spring does not bias the pusher rearward or forward and the first spring continues to bias the pusher forward toward the front end of the elongate track so that the pusher is being biased forward by a second net forward force that is greater than the first net forward force.

2. The device of claim 1 wherein:

the first and second springs are negator springs, each having a coiling portion carried by the pusher and a distal end portion secured to the track.

3. The device of claim 1 wherein:

the first spring exerts a bias force of between 120% and 300% of a bias force exerted by the second spring at least along a majority of a distance between said rearward and forward positions.

4. The device of claim 1 including a sample carrier at the front end of the track, and wherein the carrier includes:

a base, unitarily formed with at least a major portion of the track;

a sample-holding insert having first surfaces positioned to engage with mating surfaces of the base when installed thereon, said first surfaces being positioned so as to not be externally visible with respect to the display device; and a cover installable to the sample-holding insert via a sliding translation prior to installation of the sample-holding insert to the base but not nondestructively removable while the sample-holding insert is in an installed condition.

5. The device of claim 4 wherein the insert carries a sample of hair or a hair simulant.

6. The device of claim 5 wherein the sample is permanently adhered to the insert.

7. The device of claim 4 wherein:

the cover comprises a single piece of molded plastic being configured to allow a sample of product contained in the carrier to be displayed to a consumer when the cover is installed on the base;

the insert comprises a single piece of molded plastic; and the track member has a plurality of predefined relieved areas permitting predetermined rearward portions of the track to be broken off to shorten the track to accommodate a shelf having a particular depth onto which the track is placed.

8. The device of claim 1 including a sample and a sample carrier at the front end of the track, wherein the sample carrier comprises:

a base portion unitarily molded with a portion of the track; and means for mounting the sample to the base portion.

* * * * *